US005828926A

United States Patent [19]

Iwata et al.

[11] Patent Number: 5,828,926

[45] Date of Patent: Oct. 27, 1998

[54] REGISTRATION CONTROL FOR AN IMAGE FORMING APPARATUS HAVING AN INTERMEDIATE TRANSFER BELT

[75] Inventors: Nobuo Iwata, Sagamihara; Shingo Katou, Yokohama; Yutaka Shio, Yokohama; Tomonori Yabuta, Yokohama, all of Japan

[73] Assignee: Ricoh Company, Ltd., Tokyo, Japan

[21] Appl. No.: 699,035

[22] Filed: Aug. 19, 1996

[30] Foreign Application Priority Data

Aug. 17, 1995 [JP] Japan ..... 7-231959

[51] Int. Cl.[6] ..... G03G 21/00

[52] U.S. Cl. ..... 399/66; 399/71; 399/301

[58] Field of Search ..... 399/66, 71, 301

[56] References Cited

U.S. PATENT DOCUMENTS 5,499,092 3/1996 Sasaki ..... 399/66 X
5,515,145 5/1996 Sasaki et al. ..... 399/66 X

FOREIGN PATENT DOCUMENTS 1-196078 8/1989 Japan .
1-253768 10/1989 Japan .
2-282776 11/1990 Japan .

OTHER PUBLICATIONS

Japanese Abstract for 7–77880, published on Mar. 1995.

*Primary Examiner*—Nestor R. Ramirez
*Attorney, Agent, or Firm*—Oblon, Spivak, McClelland, Maier & Neustadt, P.C.

[57] ABSTRACT

A full-color image forming apparatus having a photoconductive belt on which mono-color toner images are respectively formed, an intermediate transfer belt onto which the mono-color toner images are respectively transferred to form a full-color toner image, and a transfer member for transferring the full-color toner image onto a copy sheet. The intermediate transfer belt includes timing marks printed thereon which are detected by a sensor to generate an image forming start signal for each of the first mono-color toner image forming processes. The start signal is generated by a controller only when cleaning of the intermediate transfer belt has completed and the cleaning blade has left therefrom. A timer may be used to delay the starting of the first mono-color image forming process until the transfer belt returns to a normal operating speed after the cleaning blade is removed from the transfer belt.

9 Claims, 9 Drawing Sheets

REGISTRATION CONTROL FOR AN IMAGE FORMING APPARATUS HAVING AN INTERMEDIATE TRANSFER BELT

BACKGROUND OF THE INVENTION

1. Field of the Invention

The present invention is related to a full-color image forming apparatus, in which three or four different color toner images (for example, magenta, yellow, cyan and black toner images) are formed respectively on a photo-conductive drum or belt and transferred respectively onto an intermediate transfer belt to be superimposed. The invention is further related to controlling the timing of when an image is formed after a cleaning blade is removed from the intermediate transfer belt.

2. Discussion of the Background

In a conventional color printer as shown in Japanese Laid Open Patent Publication No. 5-150574, a full-color image is made by superimposing a yellow (Y) toner image, a magenta (M) toner image, a cyan (C) toner image and a black (K) toner image. In such a device, a plurality of timing marks are also printed on an intermediate transfer belt with a same interval therebetween. Image forming for each of the four color (Y, M, C, K) toner images which are ultimately superimposed on the intermediate transfer belt is started when the timing mark printed on the intermediate transfer belt is detected by a sensor disposed at the predetermined position. The forming of the first color (for example, yellow) toner image of the full-color image is triggered by a signal produced by the sensor, after transferring of the previous full-color toner image to a copy sheet is completed.

In such a device, if the full-color toner image forming process is repeated, the image forming on the photo-conductive drum and the transferring onto the intermediate transfer belt are quickly repeated. The forming of a subsequent full-color toner image on the photo-conductive drum can be triggered by every one of the timing marks printed on the intermediate transfer belt.

However, a timing mark on the intermediate transfer belt which triggers the forming of the first color (for example, yellow) image forming for the second full-color image forming can be detected by a sensor when a cleaning device for cleaning toner remaining on the intermediate transfer belt is contacting the intermediate transfer belt. On the other hand, the forming of the second, third and fourth color (for example, Magenta, cyan and black) toner images for the second full-color image forming is triggered during the time when the cleaning device is apart from the intermediate transfer belt. This causes an evenness of an interval of the trigger signal for each of the mono-color toner image forming processes generated by the sensor due to the differences of the friction between the cleaning device and the intermediate transfer belt between the first and second through fourth images. Therefore, a start timing for forming each of the mono-color (Y, M, C, K) toner image is not generated with the same interval. As a result, the first mono-color (Y) toner image is deviated from the other mono-color (M, C, K) toner images. Accordingly, a clear and precise full-color toner image is not obtained.

SUMMARY OF THE INVENTION

Accordingly, it is an object of the present invention to obtain a precise full-color copy and achieve a high copy rate. These and other objects are achieved by a full-color image forming apparatus having a photo-conductive member such as a belt or drum onto which single color images are formed. The single color images are transferred one-by-one to an intermediate transfer belt and are superimposed onto to each other in order to form a full-color toner image thereon. From the intermediate transfer belt, the full-color image is transferred to a sheet of paper.

Between the operations of forming separate full-color images, the intermediate transfer belt is cleaned by a blade. However, the friction of the blade against the intermediate transfer belt may slow down the intermediate transfer belt. If the blade is in contact with the intermediate transfer belt when the forming of the first mono-color toner image begins, the second, third, and fourth toner images may not be properly aligned with the first toner image on the intermediate transfer belt because the blade does not contact the intermediate transfer belt at this time. Accordingly, according to the present invention, the forming of the first mono-color image does not begin until the cleaning blade is removed from the intermediate transfer belt. Further, a timer may be utilized to delay the start of the first mono-color image forming operation after the cleaning blade is removed from the intermediate transfer belt in order to allow the intermediate transfer belt to obtain a steady-state speed.

BRIEF DESCRIPTION OF THE DRAWINGS

A complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
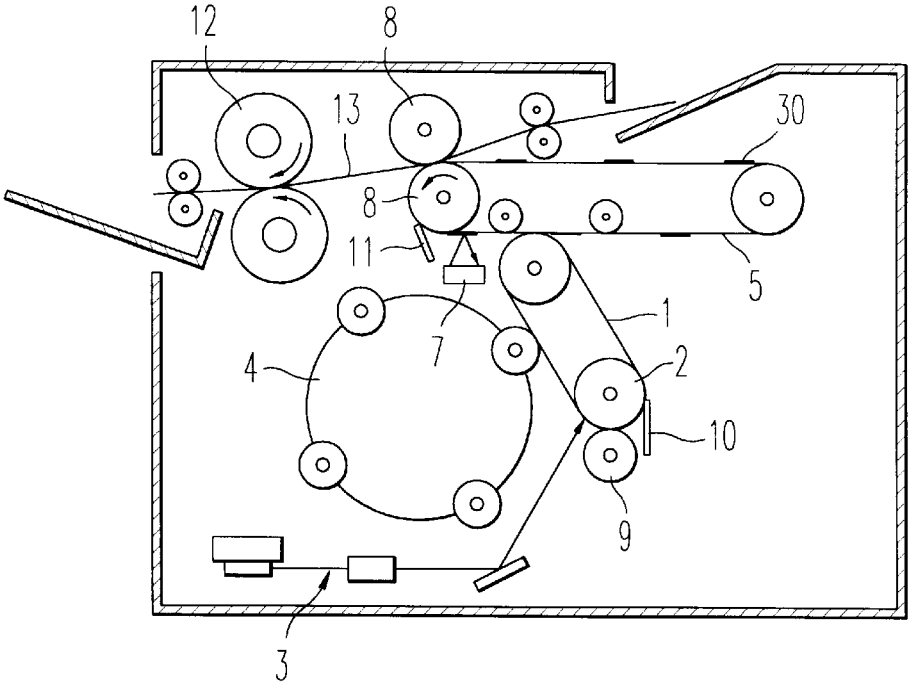
FIG. 1 is a cross-sectional view of the general structure of the image forming apparatus of the present invention.
Figure 2:
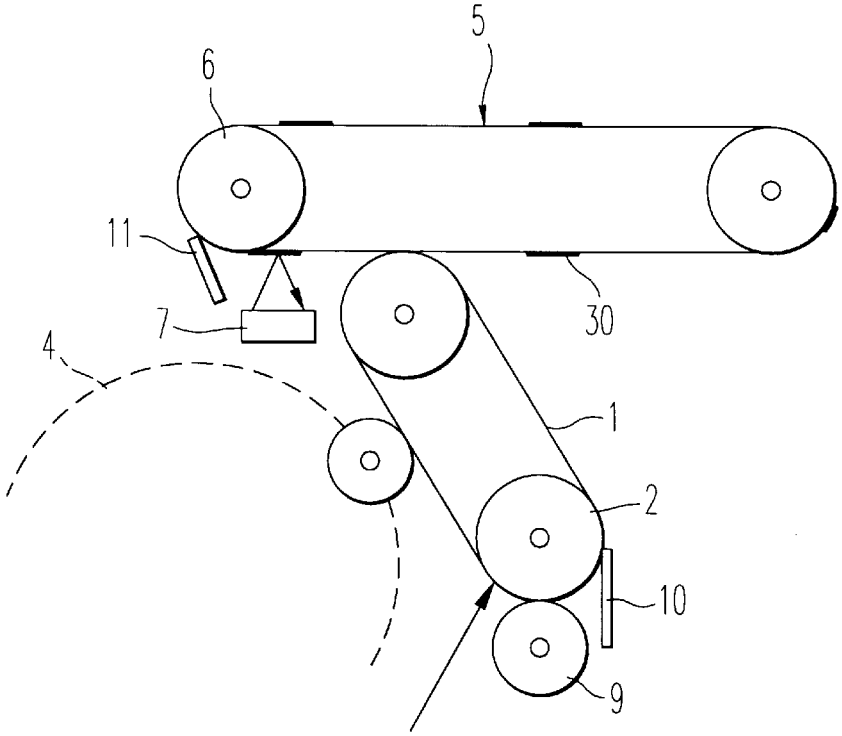
FIG. 2 is an enlarged cross-sectional view of the image forming apparatus illustrated in FIG. 1 of the present invention.

Referring now to drawings, wherein like reference numerals designate identical or corresponding parts throughout the several views, and more particularly to FIGS. 1 and 2 thereof, there are illustrated cross-sectional views of a color image forming apparatus. A photo-conductive belt (called a "PC belt" hereinafter) 1 is disposed in the color image forming apparatus. A PC belt driving roller 2 is disposed in the apparatus, around which the PC belt 1 is wound. A discharging roller 9 contacts the PC belt 1 at a predetermined position in order to remove a charge from the PC belt 1. An optical writing device 3 for optically writing an image on the PC belt 1 includes, for example, a laser, a rotating polygonal mirror, a lens and a mirror. A developing unit 4 is disposed adjacent to the PC belt 1 and includes a magenta toner developing device, a yellow toner developing device, a cyan toner developing device and a black toner developing device, each to develop corresponding latent images. The developing devices are disposed on a revolving member with a predetermined interval and the revolving member revolves a predetermined angle to face the latent image formed on the PC belt 1. There is a PC belt cleaning device 10 such as a blade for cleaning the PC belt 1 disposed beside and in contact with the PC belt 1.

An intermediate transfer belt (called an MT belt hereinafter) 5 is disposed beside and in contact with the PC belt 1 to receive four kinds of mono-color toner images from the PC belt 1 and realizes a full-color toner image thereon. The MT belt 5 is an endless belt which is seamless, meaning there is no seam on the exterior thereof to cause images transferred thereto to be disrupted by the seam. An MT belt driving roller 6 drives the MT belt 5 in a predetermined direction. Timing marks 30 are printed on the MT belt 5 at predetermined intervals. There is a timing mark detecting sensor 7 disposed down-stream of a cleaning member 11 such as a blade and is adjacent to the PC belt 1 and which detects one of the marks 30 printed on the MT belt 5. The sensor 7 generates a command signal for each of the mono-color (Y, M, C, K) toner images which triggers the forming of the respective mono-color toner images.

A transfer roller 8 is disposed above the MT belt driving roller 6 and is in contact therewith at a predetermined position. The MT belt cleaning member 11 is disposed below and in contact with the MT belt 5 at a predetermined position in order to clean the MT belt 5. A fixing device 12 is disposed down-stream of the transfer roller 8 and a copy sheet 13 is fed from the transfer roller 8 through the fixing device 12.

A color toner image forming operation is executed as follows. The PC belt 1 is uniformly discharged by the discharge roller 9. Next, the PC belt 1 is exposed by the optical writing device 3 to form a latent image thereon at the time one of the timing marks 30 printed on the MT belt is detected by the sensor 7. A latent image is developed by the first mono-color toner (for example, yellow toner) contained in the first developing device in the developing unit 4. The above mentioned mono-color toner image forming is repeated for the other color toners (for example, magenta, cyan, and black colored toner) by revolving the developing unit 4 to face the different color toner device against the respective latent images. Using this process, four different color toner images are respectively formed on the PC belt. Each of the color toner images are respectively transferred onto a same area of the MT belt 5 to be superimposed thereon. Thereby, a full-color toner image is formed on the MT belt 5 for a first image. After that, the full-color toner image formed on the MT belt 5 is transferred to the copy sheet 13 by the transfer roller 8. The copy sheet 13 having full-color toner image is fed to the fixing device 12, and the full-color toner is fixed by the fixing device 12.

After transferring the full-color toner image onto the copy sheet 13, the toner remaining on the surface of the MT belt 5 is scraped by the cleaning member 11. The cleaning blade 11 is controlled such that during the four toner image transferring processes onto the MT belt 5, the cleaning blade 11 is kept apart from the MT belt 5. After transferring the last mono-color toner image, the cleaning member 11 is then put into contact with the MT belt 5.

Figure 3:
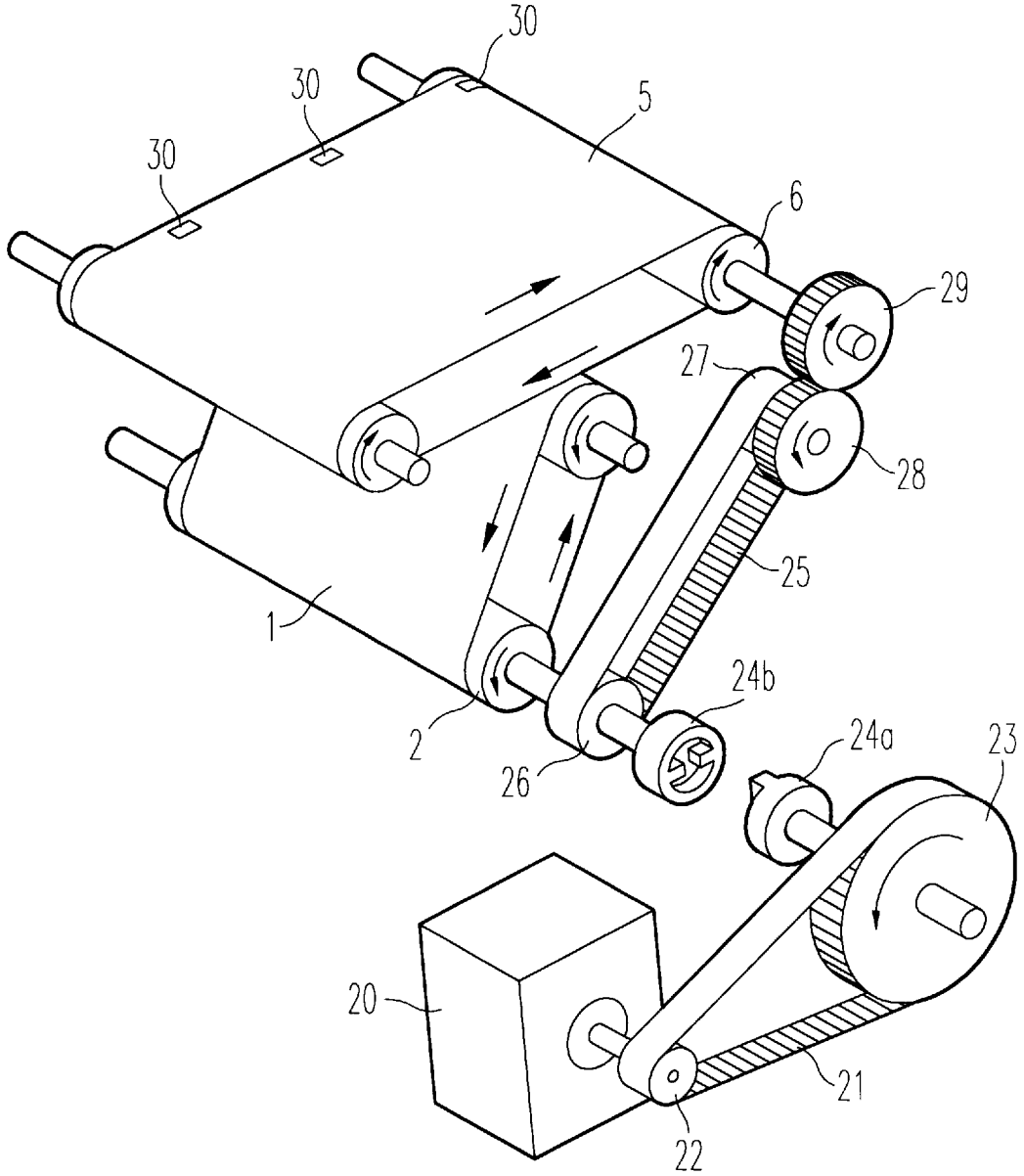
FIG. 3 is a perspective view of a photo-conductive belt, an intermediate transfer belt, and a driving mechanism.

Hereinafter, a driving mechanism of the PC belt 1 and the MT belt 5 is explained. As shown in FIG. 3, a belt driving motor 20 is disposed in the image forming apparatus. A first pulley 22 is connected to an axis of the belt driving motor 20 and a first gear belt 21 is wound around the first pulley 22. The gear belt 21 is also wound around a second pulley 23 which has larger diameter than that of the first pulley 22. A coupling device 24 is employed which includes an extending part 24*a* and a recessed part 24*b*. The extending part 24*a* of the coupling device 24 is combined with a shaft of the pulley 23 and the recessed part 24*b* thereof is combined with an axis of the PC belt driving roller 2 which has the shaft thereof unitedly combined with the recessed part 24*b*. Thereby, the PC belt driving roller 2 rotates the PC belt 1 in a predetermined direction.

A third pulley 26 is combined with a shaft of the PC driving roller 2. A fourth pulley 27 is disposed and is combined with a shaft to a first gear 28. A second gear belt 25 is wound both around the third and the fourth pulleys 26 and 27. A second gear 29 meshes with the first gear 28 and is combined with the shaft of the MT belt driving roller 6 at an end thereof. Through this arrangement, the driving force of the motor 20 is transmitted through the first pulley 22, the first gear belt 21 and the second pulley 23. Thereby, the rotational speed of the driving motor 20 is reduced. The driving force is further transmitted to the PC belt driving roller 2 through the coupling device 24. The coupling members 24*a* and 24*b* are connected with each other at the time the image forming is executed. The coupling device 24 is employed instead of gear communication because gear communication may cause an evenness of the rotation of the PC belt 1 and MT belt 5 due to bad precision and because the coupling device 24 permits the changing the PC belt 1 to be easily executed when the PC belt 1 is worn or damaged. The MT belt 5 is rotated by the driving force of the PC belt driving motor 20 via the third pulley 26, the second gear belt 25, the fourth pulley 27 and the first and second gears 28 and 29. Thereby, the motor 20 drives both the PC belt 1 and the MT belt 5.

Hereinafter, the operation of superimposing the four mono-color (Y, M, C, K) toner images employed in the present invention is explained in detail. A case where five timing marks are printed on the MT belt 5 is illustrated in the timing diagram of FIG. 4 which illustrates the image forming operations including laser beam writing, the first transferring onto the MT belt, the second transferring onto the copy paper, cleaning of the MT belt and driving of the MT belt. These processes are controlled using the timing marks which are illustrated in the figure.

Figure 4:
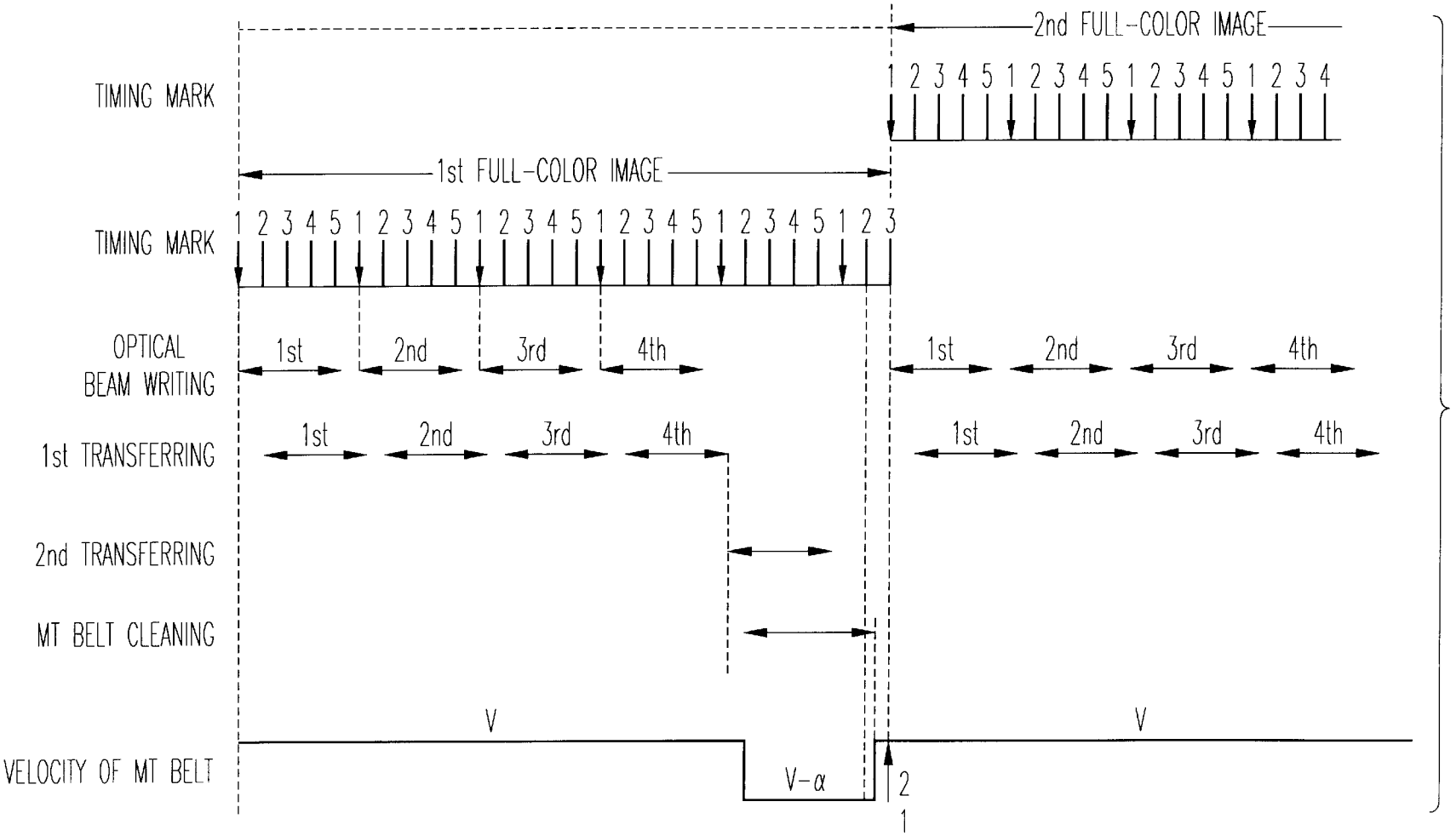
FIG. 4 is a first timing diagram of the present invention showing the relation between timing mark sensing, optical beam writing, first belt transferring, paper transferring, cleaning of the intermediate transfer belt and an intermediate transfer belt rotational speed according to the first embodiment of the invention.

In FIG. 4, a laser beam first is written onto the PC belt 1 in response to the timing mark 1 of the first cycle of the MT belt which correspond to the time when the sensor detects the first mark 30 printed on the MT belt 5 after cleaning has been completed. Thereby, a latent image is formed on the PC belt 1 which is developed by the first color toner (e.g. yellow toner). Thereafter, the first transferring is executed, namely the yellow toner image formed on the PC belt 1 is transferred onto the MT belt 5 at a predetermined timing, as illustrated in FIG. 4.

In response to timing mark 1 of the second cycle, the second laser beam writing is commenced to form a latent image for the second mono-color toner image (e.g. magenta). The latent image is developed by the second mono-color toner (magenta toner). Subsequently, the first transferring is executed in which the magenta toner image on the PC belt 1 is transferred to the MT belt 5. Thereby, the magenta toner image is transferred on the same area of the MT belt as the yellow toner image has been already transferred (e.g. superimposed). The mono-color toner image forming and the first transferring is repeated for the remaining mono-color toner images including the cyan color image and the black color image.

After the four color toner images are superimposed on the MT belt 5, the second transferring is executed. Namely, the full-color images are transferred onto a copy sheet for the first time at a predetermined timing as shown in FIG. 4. Thereby, a full-color image is formed on the copy sheet. After the second transferring is completed, the remaining toner on the MT belt is wiped by the cleaning member 11 while it is contacting the PC belt 1. The movement of the cleaning member 11 against the MT belt 5 is controlled in order to clean the MT belt as illustrated in FIG. 4.

When the cleaning member 11 contacts the MT belt 5, the rotational speed of the MT belt 1 is decreased from a speed V to a speed V-$\alpha$ because of the friction resulting from the contact of the cleaning blade 11 with the PC belt 1. Therefore, if one of the timing marks 30 is used to generate a signal indicative of timing mark 1 used to start the first mono-color toner image forming process of the second full-color image forming operation before the cleaning by the cleaning member 11 of the first full-color toner image forming operation has been completed, the interval between the timing mark 1 for the first mono-color toner image forming operation and that for the second mono-color toner image forming operation, both in the second full-color image forming operation, becomes different from the interval between the second and third mono-color toner image forming operations. Thereby, the second and following color toner images in the second full-color toner image forming are not transferred onto the same area in which the first mono-color toner image is transferred. As a result, the first mono-color toner image is deviated from the other toner images, so that full-color image becomes unclear.

In order to solve the above problem, according to the present invention, the second and following full-color toner image forming is commenced in response to a timing mark 1 which is generated in response to the earliest detection of one of the timing marks 30 printed on the MT belt 5 by the sensor 7. Namely, the timing mark 1 is generated just after the first full-color toner image cleaning has been completed by the cleaning member 11. For that purpose, the sensor 7 is disposed beside and downstream of the cleaning portion of the MT belt 5. Most preferably, the sensor 7 is disposed between the cleaning portion and the first transferring portion which is where a full-color toner image is transferred from the PC belt 1 onto the MT belt 5. This is because a waste part of the MT belt 5 where a toner image is not transferred can be minimized. Therefore, the timing mark 3 of the sixth cycle in the first full-color image forming is regarded as the timing mark 1 in second full-color toner image forming as shown in the FIG. 4.

Figure 10:
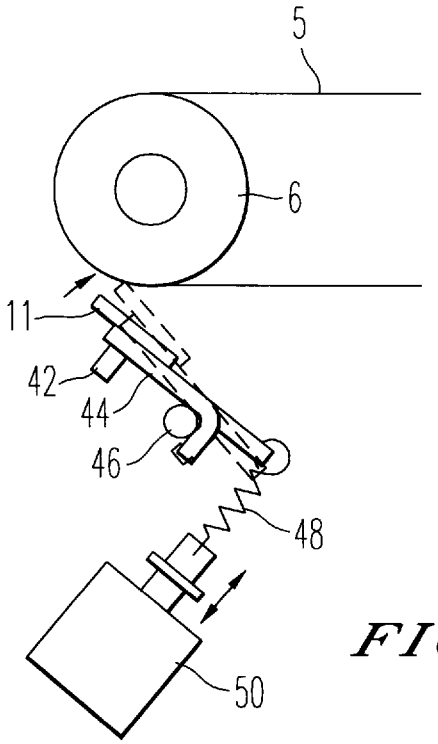
FIG. 10 is a cross-sectional view of the intermediate transfer belt, cleaning blade, and solenoid of the present invention.

The cleaning member 11 is controlled by a controller, not shown in the figures, such as a microprocessor based controller to move the cleaning member 11 from the MT belt 5 before the earliest one of the marks 30 is detected by the sensor 7 by a D.C. solenoid 50 as shown in FIG. 10. Also shown in FIG. 10 is a stopper 42, a holder 44, a pivot 46 and a spring 48 connecting the solenoid 50 to the holder 44.

In the second full-color toner image forming process, the first mono-color toner image forming is commenced in response to the timing mark 1 which corresponds to timing mark 3 in the first full-color toner image forming cycle. Subsequent mono-color toner image forming operations are also commenced in response to the timing mark 1 produced in the following cycle of the MT belt 5.

Figure 7:
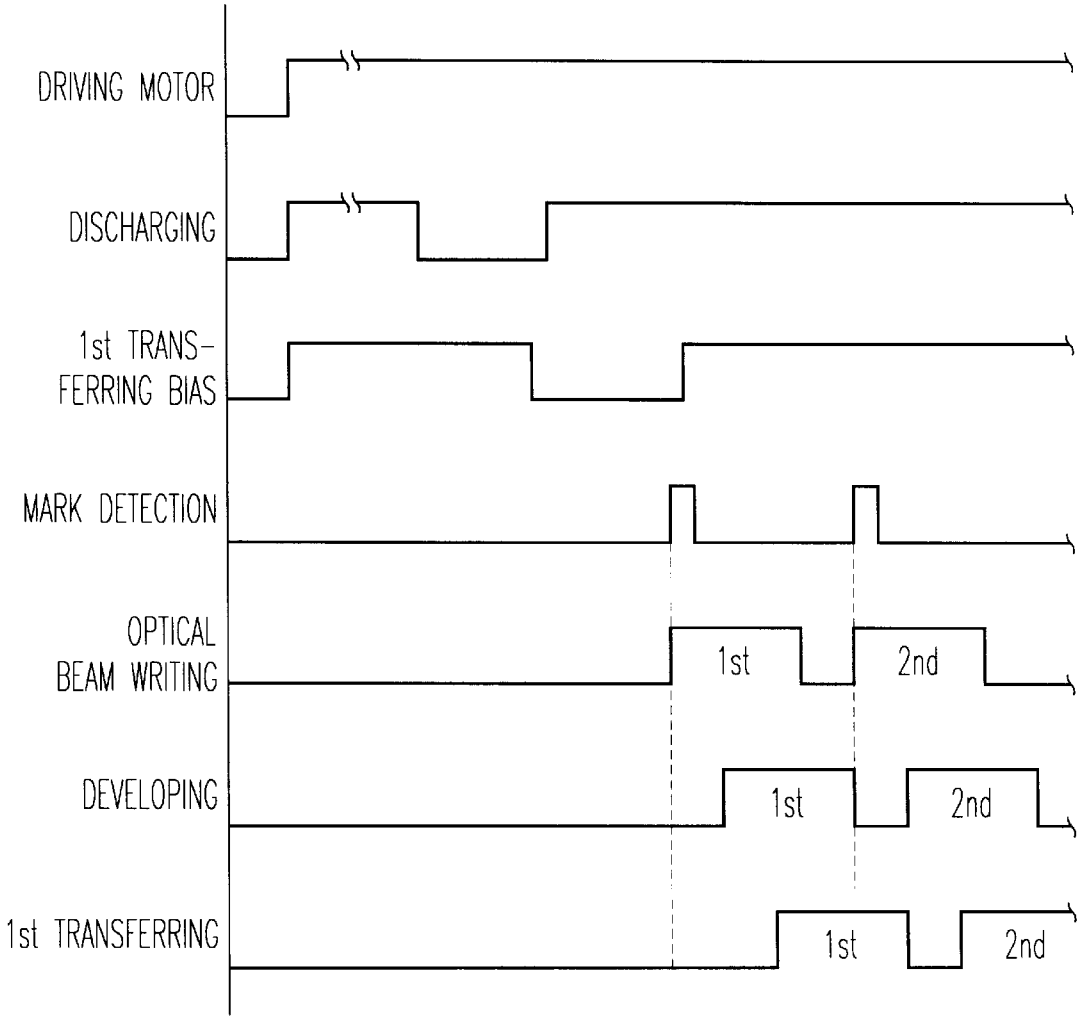
FIG. 7 is a timing diagram of the present invention showing the relation between the motor driving, the discharging of the photo-conductive belt, the first transfer biasing, the detection of the marks, the optical beam writing, the developing and the first transferring of the mono-color toner image.

The outputs and engagement of the components of the system are controlled and the marks detected as illustrated in the timing chart of FIG. 7.

Figure 8:
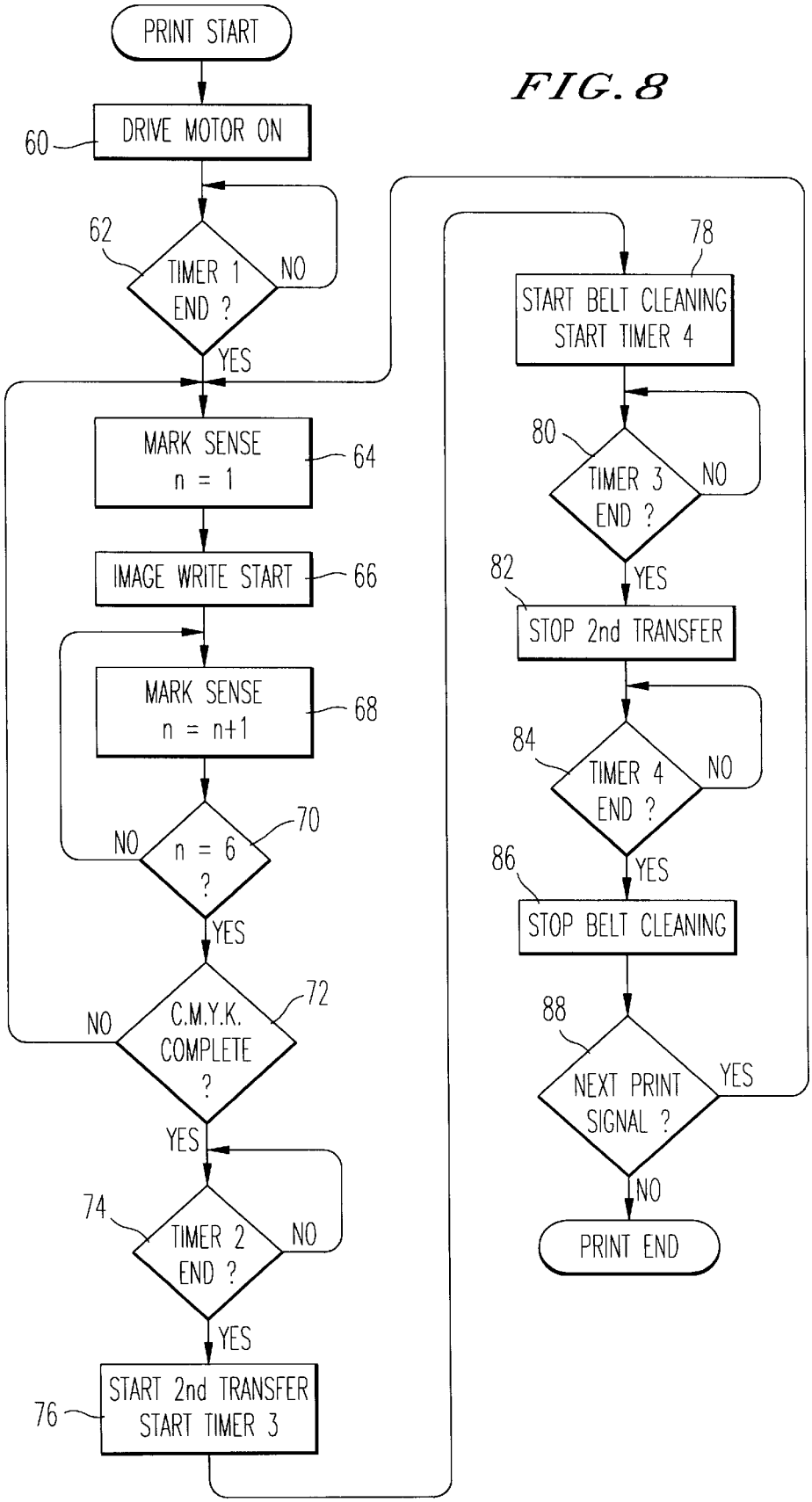
FIG. 8 is a flowchart showing the image forming process of the first embodiment of the present invention.

The steps of superimposing of the mono-color toner images according to the first embodiment of the invention are explained below with reference to the flowchart of FIG. 8. After starting, the driving motor 20 for rotating both the PC belt 1 and MT belt 5 is energized in step 60. A first timer or counter (timer 1) starts counting in step 62 to a predetermined number of pulses which correspond the time period during which the rotational speed of both of the belts 1 and 5 become stable. After that, the first mark 30 is detected by the sensor 7 in step 64 to generate the timing mark 1, which triggers the first mono-color (Y) toner image forming operation in step 66. At the same time, a counter memory, not shown in the figures, is incremented by one when a timing mark is detected by the sensor 7 in step 68. The sensor 7 continuously detects mark 30, and when the sixth mark is detected by step 70, flow proceeds to step 72 which determines if all four mono-color images are formed. In this case, the second color (M) toner image forming process is started. Thereby, the second color image forming is triggered by the same mark printed on the MT belt 5. The above-described process continues for the second, third and fourth mono-color (M, C, K) image forming processes to form a full-color toner image on the MT belt 5. During this process, the latent images are developed by the developing device and transferred respectively onto the MT belt by a transfer discharging device, not shown in the figures, onto the MT belt 5.

After the optical image writing of the Y, M, C and K images, a second timer is started in step 74 which outputs a time-up signal after a predetermined time period. When the time-up signal has occurred, the second transferring, namely the full-color transferring onto the copy sheet 13 is commenced in step 76 and a third timer is started. The cleaning of the MT belt 5 is started by the MT cleaning member 11 and a fourth timer is started in step 78. The second transferring is executed by the help of a mechanism (not illustrated) which makes the transfer roller 8 contact the MT belt 5, and by applying a predetermined bias voltage to the transfer roller 8. The cleaning of the MT belt is executed by pressing the edge of the cleaning member 11 against the MT belt 5 by the DC solenoid 50.

When the third timer is determined to have timed-out (e.g. exceeded a predetermined time) in step 80, step 82 stops the second transfer operation. The MT belt cleaning is stopped in step 86, namely the cleaning blade is withdrawn by the solenoid 50 from the MT belt 5 when the fourth timer outputs a time-up signal in step 84, which correspond the time period during which the MT belt 5 rotates one cycle of the rotation. After that, the earliest mark 30 is detected by the sensor 7 for the first color (Y) toner image forming for the second full-color toner image forming process when the next print signal is detected in step 88. The process of FIG. 8 then ends.

Figure 5:
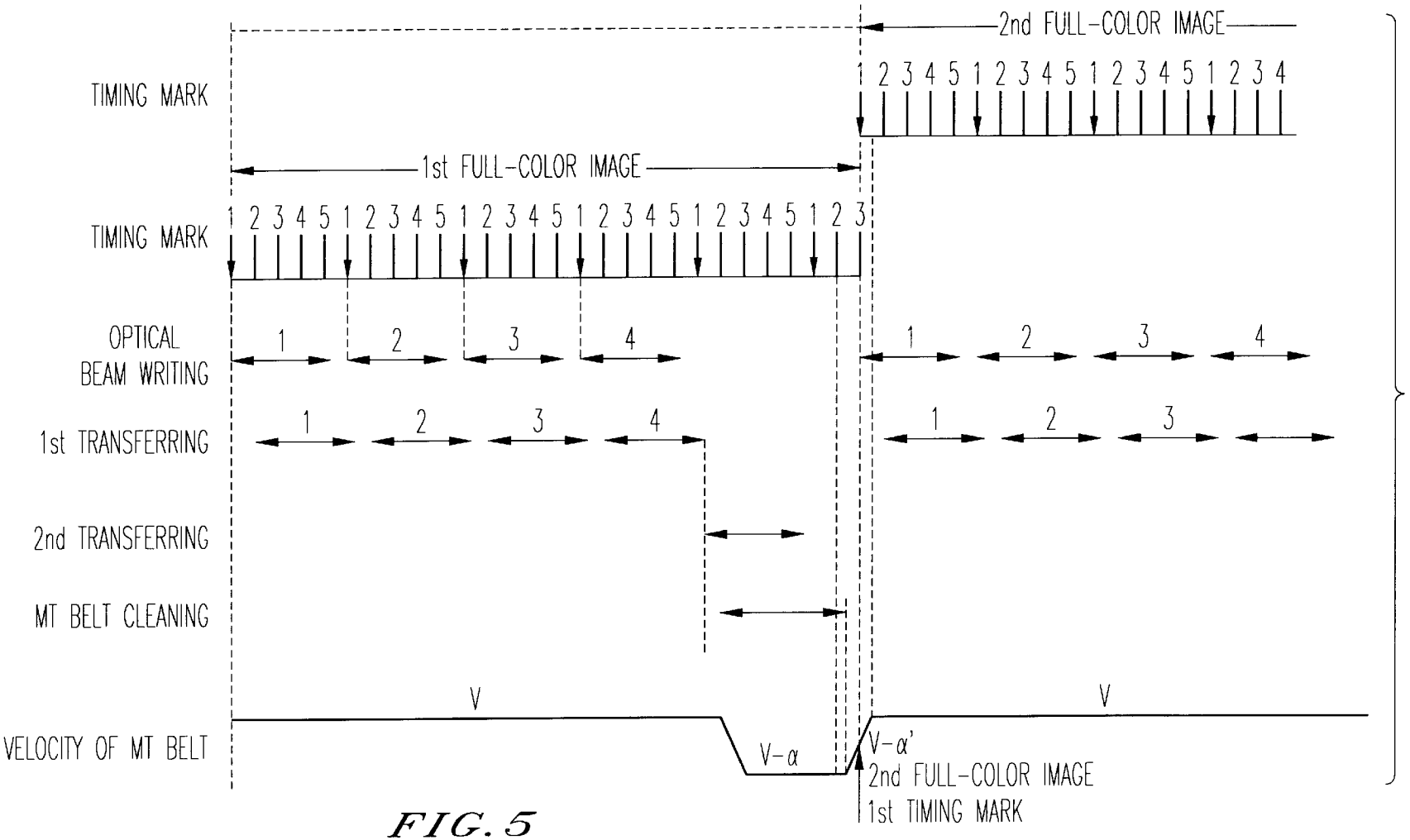
FIG. 5 is a second timing diagram of the present invention showing the relation between timing mark sensing, optical beam writing, first belt transferring, paper transferring, cleaning of the intermediate transfer belt and an intermediate transfer belt rotational speed and shows a potential problem of the first embodiment of the velocity of the intermediate transfer belt returning to a normal speed.
Figure 11:
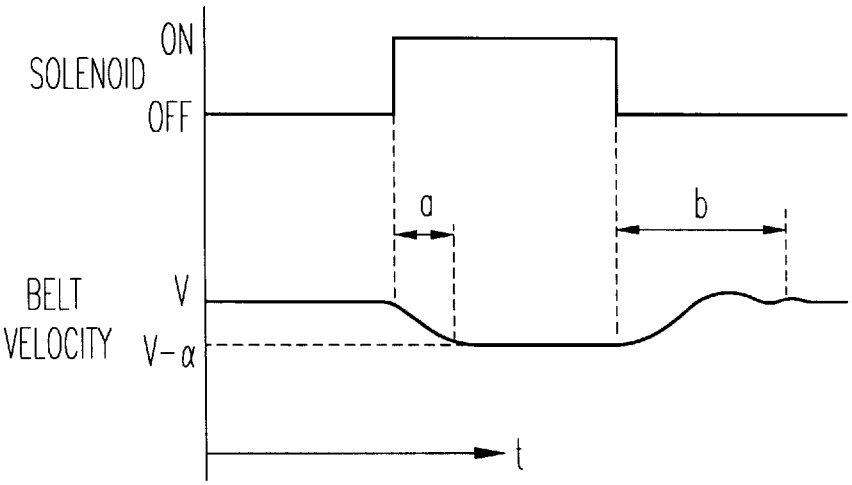
FIG. 11 is a timing diagram showing the relation between the driving of the solenoid and the velocity of the intermediate transfer belt.

Hereinafter, the second embodiment of the present invention is explained. While the velocity of the belt in FIG. 4 is shown as making an instantaneous change at the start and end of the MT belt cleaning, in actual operation, this may not be the case. As shown in FIGS. 5 and 11, when the cleaning member 11 contacts the MT belt 5 during a cleaning operation when the solenoid 50 is on, the rotational speed of the MT belt 5 is somewhat gradually decreased from speed V to speed V-$\alpha$. The speed remains at V-$\alpha$ until the cleaning of the MT belt 5 by the cleaning member 11 is completed. When the cleaning for the first full-color toner image forming has been completed and the earliest timing mark 30 is detected by the sensor 7 after the cleaning, the rotational speed of the MT belt increases from V-$\alpha$ to V-$\alpha'$, as illustrated in FIG. 5, because the cleaning member 11 no longer contacts the MT belt 5. Therefore, if the next full-color toner image forming is commenced based on the detection of the earliest timing mark 30 by the sensor 7, namely timing mark 1, there exist color deviation in the full-color toner images. This deviation is due to the difference of the MT belt speed from the desired velocity V at the timing mark 1 for the first mono-color toner image forming process. This deviation does not exist for the second mono-color image forming process, thus causing an imperfect superimposing of the first and second mono-color images of the second full-color image. The manner in which the second embodiment of the present invention overcomes this problem is explained below with respect to FIGS. 6 and 9.

Figure 6:
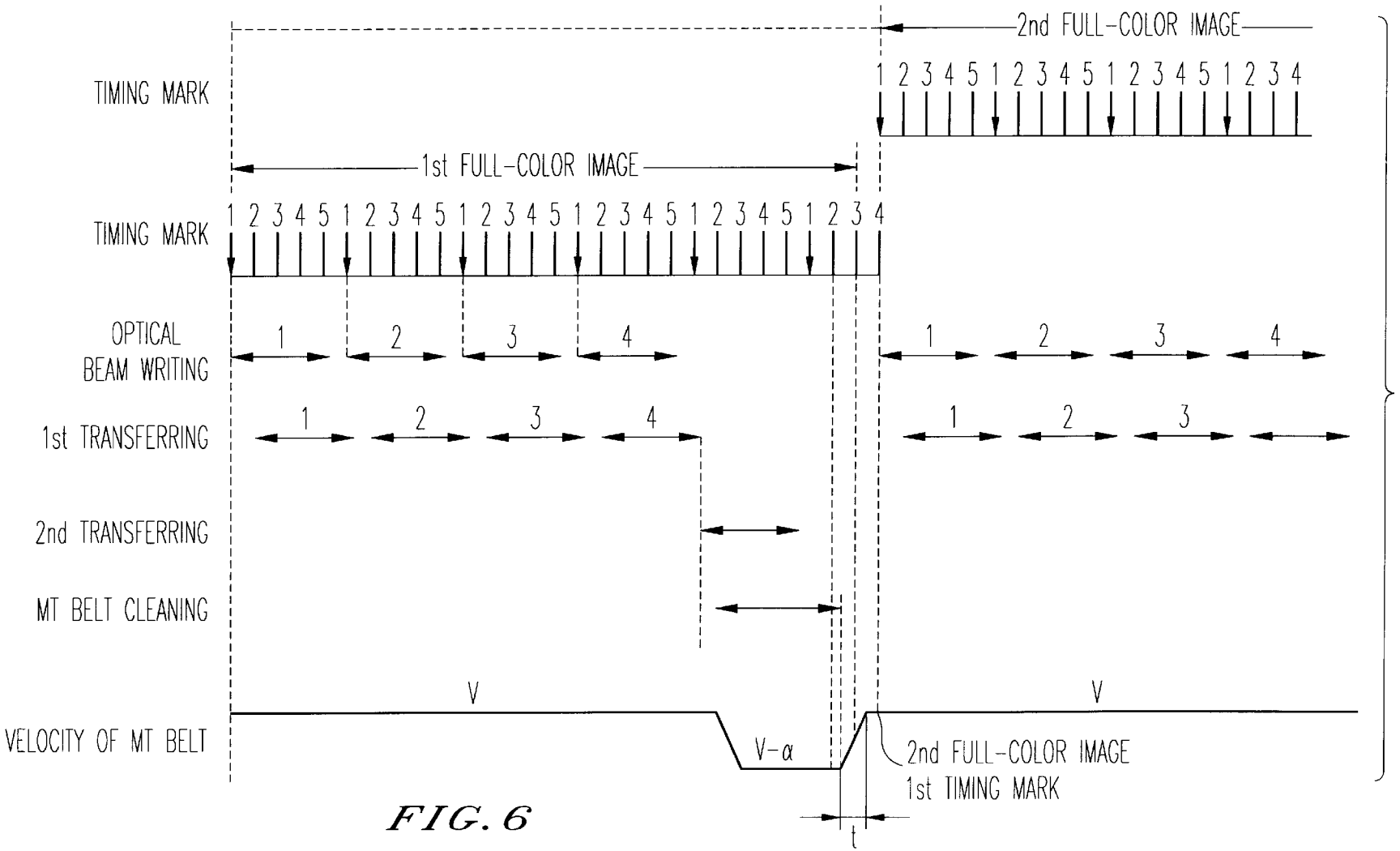
FIG. 6 is a third timing diagram of the present invention showing the relation between mark sensing, optical beam writing, first belt transferring, paper transferring, cleaning of the intermediate transfer belt and an intermediate transfer belt rotational speed according to the second embodiment of the invention.

According to the second embodiment, the start timing of the second full-color toner image forming is controlled by employing a timer which begins timing in response to a signal indicative of completion of the cleaning of the first full-color image. After this timer times-out, the first timing mark 1 is generated when the sensor detects the earliest one of the timing marks 30, as illustrated in FIG. 6. During the delay time t during which the timer is operating, the rotational speed of the MT belt 5 recover the cleaning speed of V-$\alpha$ back to image forming speed of V.

Figure 9:
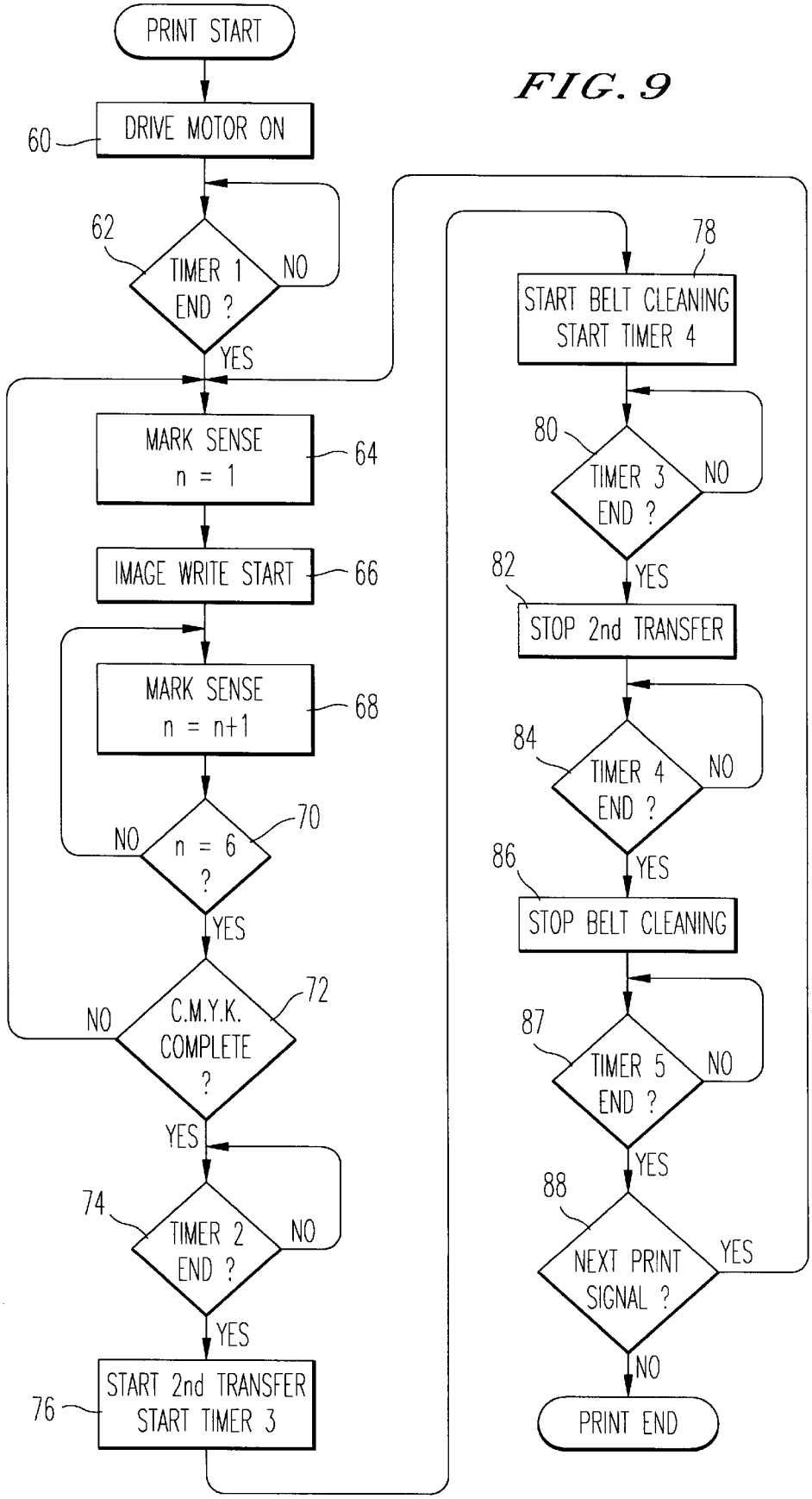
FIG. 9 is a flowchart showing the image forming process of the second embodiment of the present invention.

The steps of the superimposing of the mono-color toner images according to the second embodiment are explained below with respect to FIG. 9. The flowchart of FIG. 9 is the same as the flowchart of the first embodiment illustrated in FIG. 8 with the exception of the addition of step 87. In step 87, it is determined if a fifth timer times out. After the cleaning of the MT belt 5 is stopped, the fifth timer is started which times a predetermined time period to allow the MT belt 5 to recover to its original speed V. After the fifth timer times out, the forming of the second full-color image can begin when the next print signal is received in step 88. Thereby, color deviation is avoided and a precise full-color toner image is obtained, and a high productivity of the full-color copier or printer can be maintained.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously many modifications and variations of the present invention are possible in the light of the above teachings. It is therefore to be understood that within the scope of the appended claims the invention may be practiced otherwise than as specifically described.

What is claimed as new and is desired to be secured by Letters Patent of the United States is:

1. A full-color toner image forming apparatus, comprising:

a photo-conductive member on which predetermined mono-color toner images are respectively formed in a predetermined order;

an intermediate transfer member onto which each of said mono-color toner images are respectfully transferred to form a full-color toner image thereon;

a final transfer member for transferring said full-color toner images from said intermediate transfer member to a copy sheet;

a cleaning device for cleaning said intermediate transfer member;

timing marks disposed on said intermediate transfer member;

a sensor for detecting one of said timing marks to generate a start signal for starting a first mono-color toner image forming process;

a controller for adjusting a start timing of subsequent mono-color toner image forming processes using said timing marks so that subsequent mono-color images are superimposed on said first mono-color image, and for starting of generating said start signal for said first toner image forming process only when said cleaning device is apart from said intermediate transfer member; and a timer means for delaying an output of said start signal by a predetermined time period, and which begins timing after the cleaning device is moved away from the intermediate transfer member.

2. An apparatus according to claim 1, wherein:

said controller generates said start signal when said cleaning device is apart from said intermediate transfer member and one of said timing marks is detected by said sensor, said timing marks being disposed at a substantially constant interval on said intermediate transfer member.

3. A full-color toner image forming apparatus as claimed in claim 1, wherein:

said mono-color toner images are magenta, yellow, cyan and black color toner images and said first mono-color image is one of said mono-color toner images.

4. A full-color toner image forming apparatus as claimed in claim 1, wherein:

said intermediate transfer member is a seamless endless belt.

5. A full-color toner image forming apparatus as claimed in claim 1, wherein:

said cleaning device includes a blade and a solenoid, one edge of the blade contacts with and is moved away from said intermediate transfer member by the solenoid.

6. A full-color toner image forming apparatus as claimed in claim 1, wherein:

said sensor is a light reflecting sensor disposed just down-stream of said cleaning device.

7. A full-color toner image forming apparatus as claimed in claim 1, wherein:

said controller includes a counting means for counting said timing marks and outputs said start signal for subsequent mono-color toner image forming processes when said counting means has count up to a predetermined number of said timing marks.

8. A color toner image forming apparatus, comprising:

a photo-conductive member on which predetermined mono-color toner images are respectively formed in a predetermined order;

an intermediate transfer member onto which each of said mono-color toner images are respectfully transferred to form a full-color toner image thereon;

a final transfer member for transferring said full-color toner images from said intermediate transfer member to a copy sheet;

a cleaning device for cleaning said intermediate transfer member;

timing marks disposed on said intermediate transfer member;

a sensor for detecting one of said timing marks to generate a start signal for starting a first mono-color toner image forming process;

a controller which controls a start timing of subsequent mono-color toner image forming processes using said timing marks so that subsequent mono-color images are superimposed on said first mono-color image, and for starting of generating said start signal for said first toner image forming process only when said cleaning device is apart from said intermediate transfer member; and a timer which delays an output of said start signal by a predetermined time period so that said intermediate transfer member reaches a predetermined speed.

9. An apparatus according to claim 8, wherein: said timer begins timing after the cleaning device is moved away from the intermediate transfer member.

* * * * *